United States Patent [19]

Fecker et al.

[11] 4,114,823

[45] Sep. 19, 1978

[54] YARN DELIVERY APPARATUS FOR USE WITH TEXTILE MACHINES

[75] Inventors: Josef Fecker, Bisingen-Steinhofen; Gustav Memminger, Freudenstadt, both Fed. Rep. of Germany

[73] Assignee: Gustav Memminger, Freudenstadt, Fed. Rep. of Germany

[21] Appl. No.: 827,966

[22] Filed: Aug. 26, 1977

[30] Foreign Application Priority Data

Sep. 20, 1976 [DE] Fed. Rep. of Germany ..... 2642183

[51] Int. Cl.[2] ..... B65H 51/20

[52] U.S. Cl. ..... 242/47.01; 66/132 R

[58] Field of Search ..... 242/47.01, 47.02, 47.03, 242/47.04, 47.05, 47.06, 47.08, 47.09, 47.1, 47.11, 47.12, 47.13; 66/132 R; 139/452

[56] References Cited

U.S. PATENT DOCUMENTS

| | | | |
|---|---|---|---|
| 3,820,731 | 6/1974 | Rosen | 242/47.12 |
| 3,883,083 | 5/1975 | Rosen | 242/47.01 |
| 3,999,717 | 12/1976 | Jacobsson | 242/47.01 |
| 4,056,239 | 11/1977 | Fecker et al. | 242/47.01 |

*Primary Examiner*—Stanley N. Gilreath

*Attorney, Agent, or Firm*—Flynn & Frishauf

[57] ABSTRACT

To prevent formation of kinks or twists upon uncontrolled removal of yarn from a storage drum, an intermediate yarn guide element 20 is located between the lower edge 18 of the storage drum and the pull-off guide eye, the intermediate yarn guide element 20 being formed with at least one yarn guide edge located laterally with respect to the axis of rotation 24 of the drum 1 and in the path of the yarn from the storage winding to the removal guide eye. The yarn guide edge is extended to terminate into an elongated narrow guide slot 23 formed in the intermediate yarn guide element, the slot extending from the guide edge inwardly towards the axis of rotation of the drum. A movable yarn sensing element 30 is located in a position between the yarn guide edge 25 and the yarn removal guide eye, and biased for movement of the yarn towards the axis of rotation of the drum, and moved counter its bias by the tension of the yarn passing thereover and being pulled off, the sensing element effecting stop-motion of the machine upon loss of tension and additionally guiding the yarn into the narrow guide slot which prevents kinking, or uncontrolled looping thereof.

21 Claims, 6 Drawing Figures

FIG.3
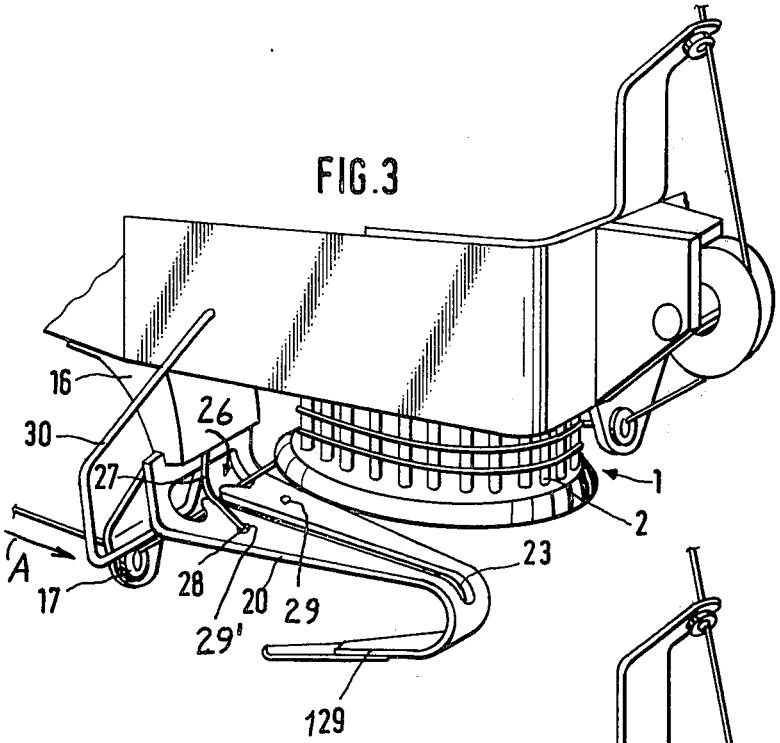
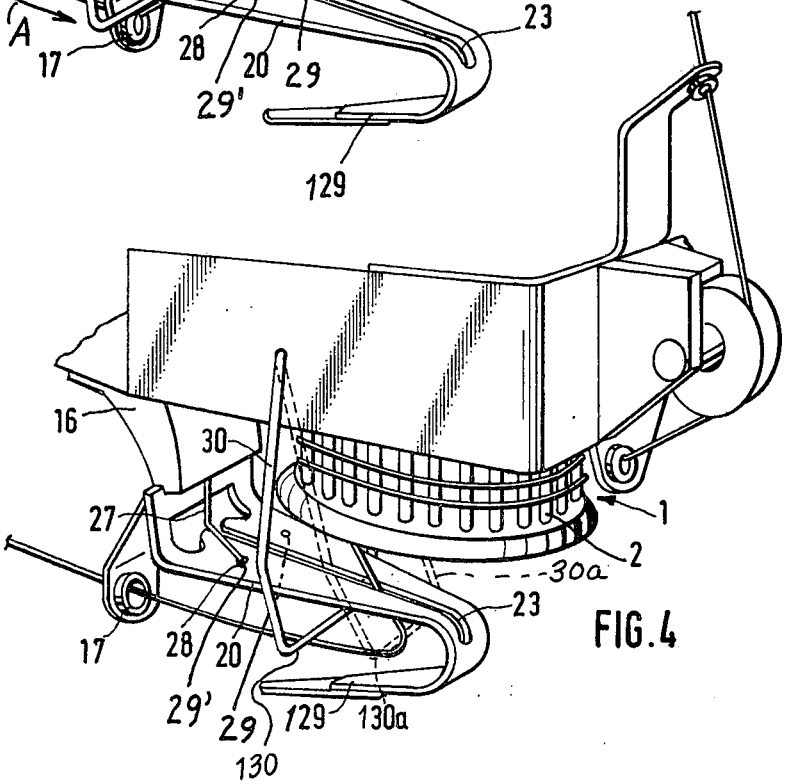
FIG.4

FIG. 6
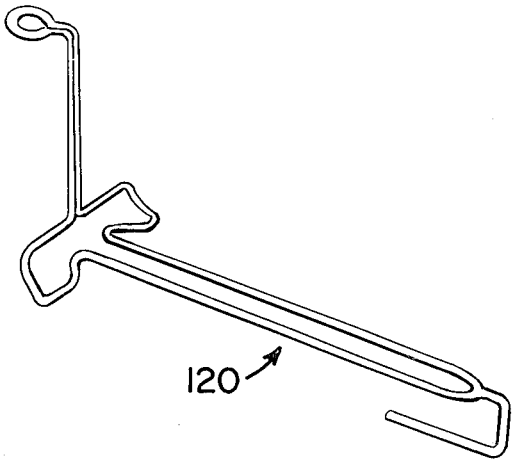
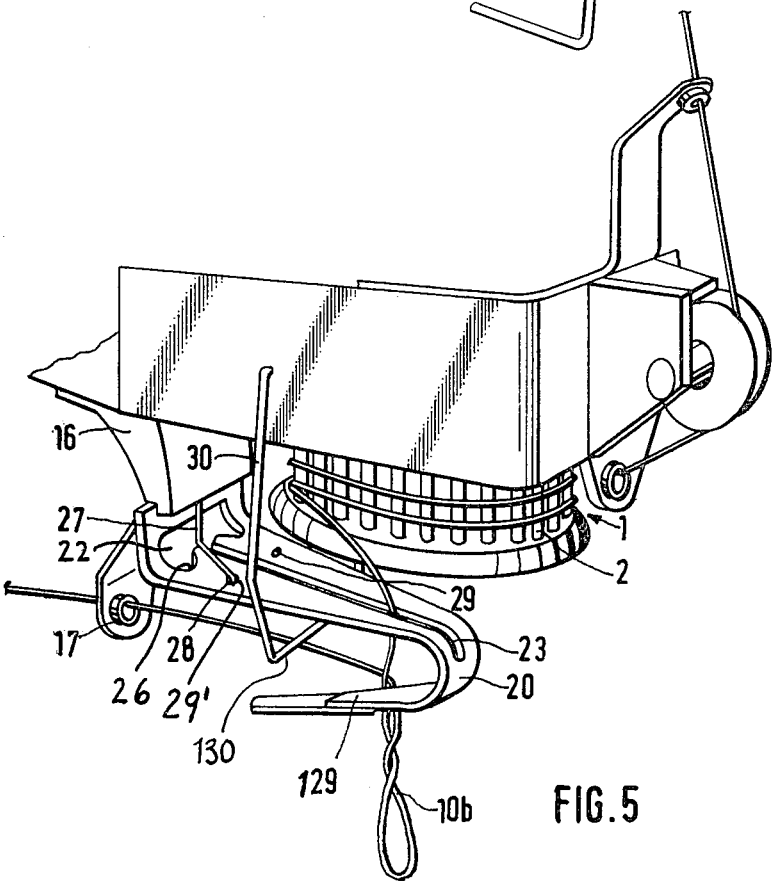
FIG. 5

YARN DELIVERY APPARATUS FOR USE WITH TEXTILE MACHINES

REFERENCES

German published application DT-AS No. 2 341 498.
German disclosure document DT-OS No. 26 08 590.

The present invention relates to yarn delivery apparatus for use in combination with textile machines, and more particularly for knitting machines, especially circular knitting machines, in which a storage drum is provided on which a plurality of storage windings are looped. The yarn is supplied tangentially to the storage drum and is intended to be removed through a yarn guide element, for example a yarn guide eye located below the lower edge of the drum. The yarn tension of the yarn being pulled off can be sensed by a stop-motion sensor.

BACKGROUND AND PRIOR ART

Yarn delivery or yarn supply apparatus having a storage drum which is rotatable and carries one or usually a plurality of storage windings have been previously proposed. It is customary to pull off the yarn over the end, or head or the storage drum. This is obtained by locating the yarn guiding eye roughly coaxially to the axis of rotation of the storage drum, and axially spaced from the lower edge thereof. An additional thread guide element is provided which defines the pull-off position at the lower edge of the storage drum when positive yarn guiding is to be achieved. One such system is described in the referenced published German patent application DT-AS No. 2 341 498. When using yarn, or threads or other filamentary material which has S or Z twists, or in general when using yarn which is highly twisted or spiraled, the situation may arise that when the tension decreases below a certain minimum value, the yarn tends to form loops or kinks. Formation of loops or kinks results in irregularities in yarn supply and may lead to immediate, or subsequent stopping of the machine since the run out sensors are operated. It is also possible that the kinks or loops will hook into machine elements causing tearing of the yarn or other filamentary material. The utilization characteristics of highly twisted yarns and yarns of the typed described also depend on the direction of rotation of the storage drum. This causes difficulty since the yarn supply arrangement usually are provided to operate only in one direction of rotation of the storage drum.

It has previously been proposed—see the referenced German disclosure document DT-OS No. 26 08 590—to permit selective utilization of yarn having S or Z twists by locating a pull-off or take-up eye laterally adjacent a storage drum and a predetermined distance below the lower edge thereof so that the yarn or thread being pulled off is guided downwardly with an inclination over the edge of the storage drum. The pull-off guide element need not be an eye; other guide elements can be used. In operation, any loops or kinks in the thread which might arise upon decrease of yarn tension will not result in wrapping or formation of the loops on the storage drum, which might block yarn pull-off; additionally, the arrangement prevents pulling off more than one winding from the storage windings wound on the storage drum.

Some yarns require operation with extremely low thread tension in the region between the storage drum and the utilization position, for example a knitting feed of a circular knitting machine. Particularly, if the yarn is twisted, it has been found that difficulties in pull-off of the yarn may still arise, particularly if the direction of rotation of the storage drum and the direction of twist of the yarn are relatively so arranged that during pull-off at low tension, the yarn tends to form kinks or loops or portions twisted upon itself.

THE PRESENT INVENTION

It is an object of the present invention to provide a yarn delivery apparatus which is capable of handling highly twisted yarn, or yarn with S or Z twists at low tension in the region between the storage drum and the utilization position, without interference with pull-off due to formation of loops, kinks, or uncontrolled twists.

Briefly, an intermediate yarn guiding element is placed between the lower edge of the storage drum and the yarn guide element, for example the pull-off eye, which is fixed in position and which is formed with a yarn guide edge which then merges into a narrow guide slot. The yarn guide edge is located laterally with respect to the axis of rotation of the storage drum, the narrow guide slot extending generally towards the axis of rotation of the drum. A movable yarn sensing element is located in the path of the yarn between the guide edge and the usual yarn guide means, for example the pull-off eye. The sensing element is biased to move towards the center of rotation of the yarn guide drum and, if the tension of the yarn being pulled off is proper, is moved by the tension away from the axis of rotation.

The yarn can be supported by the guide edge of the intermediate storage element in its path in advance of the yarn sensor. This permit operation of the textile machine with very low yarn tension. Upon trouble in the machine which, for example, results in loss of tension of the yarn, any loops or twists which might otherwise occur with highly twisted yarns are prevented from reaching the utilization position since the narrow guide slot, in which the yarn will be guided if tension is lost, or substantially decreased, prevents the further travel of kinks or loops or twists of the yarn upon itself, and permits automatic pull-off of the yarn in a single straight thread.

Drawings, illustrating and example:

FIG. 3 is a perspective view of the apparatus illustrating operation with normal, or design tension;

FIG. 4 is similar to FIG. 3 and illustrates operation upon decrease of tension of the yarn being pulled off and showing of the yarn sensor, or stop-motion in solid lines, and broken lines, respectively;

Figure 1:
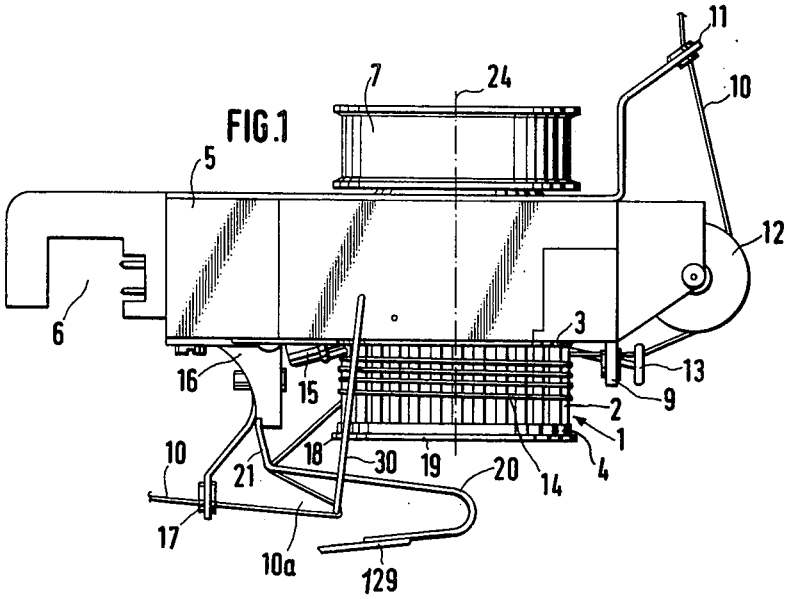
FIG. 1 is a side view of the yarn delivery apparatus, in schematic representation, and omitting parts not necessary for an understanding of the invention.

And FIG. 5 is an illustration similar to FIG. 4 and showing the position of the yarn after the stop-motion device has responded and usual twist which occurs due to continued rotation of the drum as a result of inertia;

and FIG. 6 is a perspective view of a modification of the intermediate yarn guide elements.

The drum 1 (FIG. 1, 3–5) may have any suitable form but, in the preferred form as shown, it is constructed similar to a squirrel cage—to use terminology customary with electrical induction motors of similar form—in which two end disks 3, 4, have connecting pins or rods 2 located around the circumference. Upon rotation, the outer circumference of the pins or rods 2 will form the envelope of a cylinder. The storage drum is secured to a vertical shaft—not shown—which is journaled in a bracket or holder 5. The drum is rotated by engagement with a suitable drive means, for example by being coupled to a pulley 7 around which a drive belt can be looped. The bracket 5 is formed with a hook-like end portion leaving a recess 6 so that the bracket 5 can be secured to the holding ring customary in circular knitting machines on which thread supply drums are secured. The connection between the pulley 7 and the drum 5 is such that rotation is transmitted from the pulley 7 to the drum 5, the pulley 7 itself being engaged by a flat belt driven separately, or from the drive mechanism of the knitting machine.

A leading, or supply thread guiding eye 9 is located approximately at adjacent the upper level of the drum 1. Yarn 10, supplied from a yarn package (not shown) is guided through a first guide eye 11, through a thread brake 12 and then through an inlet eye 13 connected to stop-motion sensor and sensing the presence of thread being supplied to the supply eye 9. Eye 9 guides the thread tangentially onto the drum 1.

The yarn forms a storage winding 14 on the drum 1. The storage winding 14 consists of a plurality of loops or wraps of the yarn around the drum. It is fed downwardly axially by suitable means, for example an inclined gear 15 which engages between the gaps formed by the spaced pins 2 of the drum 1 (see FIG. 1). The gear 15 is located on a shaft secured to the holdder 5 to be freely rotatable, so it can be driven by the storage drum 1. Its axis of rotation is inclined with respect to a horizontal plane.

A holding bracket 16 is secured to bracket 5, for example by screws, and has a run-out, or pull-off thread guide element 17 secured thereto. The thread guide element 17 is formed as an eye with a horizontal axis, in order to guide the yarn 10 from the storage windings 14 on drum 1 to a utilization position, for example the feed of a knitting machine.

The yarn removal eye 17 is located laterally adjacent drum 1, and is placed axially lower than the lower edge of the drum 1 (see FIG. 1). The lower disk 4 of the drum 1 has a radially extending flange 19 formed thereon, the yarn being pulled-off over the edge of the flange 19 laterally downwardly with an inclination due to the relative position of the guide eye 17 with respect to the drum 1 (see FIG. 3).

In accordance with the present invention, an intermediate guide element 20 is located between the lower edge 18 of the drum 1 and the guide eye 17. The intermediate guide element 20 is fixed with respect to the drum 1 and, usually, is constructed as a sheet metal element which is essentially parallel to, or only slightly inclined with respect to the lower disk 4 of the drum 1. It is axially spaced from the lower disk 4. The intermediate guide element 20 has a support portion 21 which is approximately at a right angle to the direction of the path of the yarn 10 taken upon removal from the drum 1. The portion 21 is formed with a wide opening 22 (FIGS. 2, 3) from which a narrow guide slit 23 extends up to about the axis of rotation 24 of drum 1. The guide slot 23 has its main axis located in a plane which includes the axis of rotation 24 of the drum 1 and the axis of the pull-off, or removal guide eye 17. Its width is so selected that it is just slightly wider than the order of magnitude of the diameter of the thread 10 being handled by the apparatus.

The opening 22 in the intermediate guide element 20 is formed to provide guide edges 25, 25', located, respectively, at the lateral terminal ends of the narrow guide slot 23. The guide edges 25, 25' are located in respective depressions 26 extending from the opening 22. The edges 25, 25' are thus formed by portions of the edges defining the opening 22, which extends transversely within the intermediate guide element 20.

The thread guide edges 25, 25' are preferably reinforced by a ceramic, or other highly abrasion resistent material in order to prevent the formation of grooves in the guide edges in extended operation. Such reinforcements are known and are not specifically shown in the drawings. The guide edges need not be shaped as illustrated specifically in FIG. 2; the guide edges could be shaped, for example, in form of an inclined straight edge.

An adjustable directing element 27, best seen in FIGS. 3–5 is secured to the intermediate element 20. It is generally L-shaped, and formed as a wire bail which has a hook-shaped end portion 28 fitting in corresponding holes 29, 29' of the intermediate guide element 20. The other end of the directing bail 27 is rotatably secured to the intermediate element 20. The directing element 27 is so positioned and so shaped that it covers one of the guide edges 25, 25', respectively, depending on the position of the hook-shaped end 28 in the respective hole 29, 29'. The respective position then places the bail 27 transversely across the opening 22 from a guide edge 25, or 25' respectively, which is covered towards the adjacent edge of the guide slot 23. The directing bail is provided to insure that the yarn 10 passing through the opening 22 can engage only one of the guide edges 25, 25', that is, can be guided only over that edge which is not covered by the directing bail 17.

Figure 2:
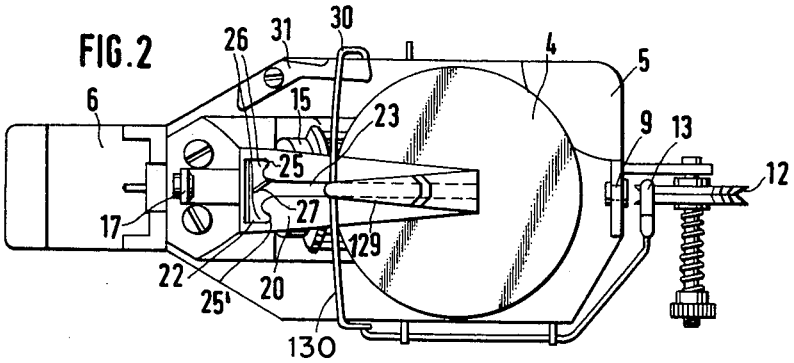
FIG. 2 is a bottom view.

The intermediate element 20 is formed with a loop or kink deflecting extension 129 in the form of a general U-shaped portion (see FIG. 1) projecting below the portion of the element 20 in which the slit 23 is formed. The loop deflector 129 tapers laterally, that is, is laterally conical as best seen in FIG. 2.

The thread pull-off sensor is formed as a general U-shaped bail 30 secured to the bracket 5. Bracket 5 is channel or duct-shaped to hold the sensor bail 30. Bail 30 is pivotable about a generally horizontal axis, and the transverse portion of the bail 30 is normally positioned in the range of the guide edge 25 when pulled over towards that position by the yarn 10 in the path towards the pull-off eye 17. The bail 30 is biased by a suitable force applying element, the force of which is indicated schematically by arrow A (FIG. 3). The force can be applied against the bail by a spring, by a gravity linked weight connected to the bail, or the like. The direction of the force indicated by arrow A is such that the bail 30 tends to tip or pivot towards the axis of rotation 24 of the drum 1. The transverse portion of the bail is placed in the space between the intermediate guide element 20 and the loop deflector 129. Bail 30 senses the tension of the thread 10 being pulled off. The thread 10 engages the bail 20. In normal, ordinary operation it will have the position seen in FIG. 3. If the tension of the yarn decreases, bail 30 moves toward the right (FIG. 1) to reach a position which is approximately shown in FIG. 1. In this position, the lateral legs of the bail 20 are approximately parallel to the axis of rotation 24 of the drum 1. In this position, the contacts of the associated stop-motion device are operated to cause the machine to stop. The bail can pivot continuously, further, however, in counter-clockwise direction (FIG. 1) to the position shown in broken lines in FIG. 4 in which the transverse portion 130 of the sensor 30 is in the vicinity of the axis of rotation 24 of drum 1, or even intersects this axis 24. In this position, the electrical terminals operated by the bail 30 are in a state which permits the machine to operate, or run. A catch 31 (FIG. 2) permits locking the bail 30 in the position shown in broken lines at 30*a* in which the transverse portion 130*a* is in the vicinity of the axis of rotation 24. Catch 31 is pivoted on the bracket 5.

Operation: yarn 10, supplied from a yarn package, or pirn, not shown, is guided through eye 11 and then over the thread brake through sensor 13 and inlet eye 9 to be wound on the rotating storage drum 1 on to form storage windings 14 thereon. The yarn is removed from drum 1 at the same speed with which it was supplied through guide eye 11, and is taken off the delivery system through the eye 17. In ordinary operation, the storage windings 14 will always have the same quantity of yarn thereon. The yarn is axially moved downwardly by the feed wheel 15. The tension of the yarn being removed is sensed by the sensing bail 30 which, in ordinary operation, is in the position shown in FIG. 3. The directing bail 17 is so adjusted that, for the specific direction of rotation selected for the drum 1, the guide edge 25 or 25', respectively, which is not used, that is, guide edge 25' in FIG. 3, is covered. The yarn being removed is threaded through an opening 22 and then through the depression 26 which is not covered by the directing bail 27.

If the thread tension in the region between drum 1 and the utilization point decreases, yarn 10 is resiliently guided downwardly under loading of the biased bail 30, so that the thread will be guided and supported by the edge 25 in the respective depression 26. The thread is deflected to assume the path shown, for example, in FIG. 1, or in FIG. 4, solid lines. The yarn or thread 10 will form a loop 10*a* in the region between the edge 25 and the take-out, or removal eye 17. The extent of this loop 10*a* can be changed by suitably adjusting the operation of the contacts by the bail 30, that is, by setting the deflection position of the bail 30 at which the stop-motion is operated. If there was no malfunction at the utilization position but merely a slight irregularity in thread consumption, as is possible in working with small patterns, due to pull by the needle, or working plush fabric, then the loop 10*a* will be so small that the bail 30 does not move into the position in which the stop-motion device will respond. Thus, some thread reserve is provided which permits compensation of high frequency variations in thread consumption.

Malfunction of the textile machine at the utilization point will cause the bail 30 to assume the position in which the stop-motion mechanism responds. In other words, the loop 10*a* will become so great that the bail 30 can move farther towards the right (FIG. 1) and the machine will be stopped. The adjustment for this position is preferably so made that the longitudinal legs of the bail 30 are approximately parallel to the axis of rotation 24 of the drum 1—see FIG. 5. When bail 30 has reached this position, and the stop-motion has responded, the loop 10*a* is no longer held tensioned by the bail 30. The drum 1 does not stop immediately after the stop-motion device responds. There is a certain inertia causing overrun of the drum and consequent spilling of yarn. Initially, the drum 1 will thus supply more yarn 10 than the machine is capable of consuming at the respective position. Consequently, the loop 10*a* will increase due to frictional engagement of the thread 10 with the edge 19 of the drum, the thread or yarn 10 will be removed from the depression 26 and will be guided by the directing bail 27 into the longitudinal slits 23 to slide in the direction of the axis of rotation of the drum 1. Eventually, the drum 1 will stop. This condition is illustrated in FIG. 5. The yarn which was no longer consumed at the utilization point will then form an extended loop 10*b* (FIG. 5) which usually twists about itself. It hangs down through the slit 23. The loop deflecting element 129 which is positioned downwardly with respect to the element 20 guides the loop 10*b* in a lateral position.

When the malfunction at the utilization position has been cleared and the machine is back in operation, yarn 10 is pulled through the pay-out eye 17. This, first, uses up the loop 10*b*. The deflection element 129 prevents catching of the yarn on the guide element 20 or on any other part of the machine, or an accessory thereof. Eventually, yarn 10 is guided into the slit 23 and then through the slit to the opening 22. This also causes engagement of the stop-motion bail 30 and raising thereof. The stop-motion is disengaged. Eventually, the yarn 10 snaps over the hump adjacent the end portion of the slit 23 and offsetting the recess 26 to again resume the position shown in FIG. 3, that is, normal operating position of the yarn.

The condition may arise that loops may form in the region between the drum 1 and the guide element 20. Such loops may have an appearance similar to the loop 10*b* (FIG. 5). Kinks or loops in that region are prevented from passing through the eye 17 by the slit 23, so that they cannot reach the utilization position; rather, they are pulled out, that is, the thread kinks are first used up and loops or twists are prevented from longitudinal movement by the slit 23.

In setup of circular knitting machines it is sometimes advantageous not to use tangential removal of the yarn, as shown in FIG. 3, but rather to pull off the yarn end-over-end from the drum, so that the yarn 10 can be pulled off the drum 1 with any desired removal speed. If this operating mode is employed, bail 30 is flipped beyond its stop-motion position of FIG. 5 into the position shown in broken lines in FIG. 4 in which the stop-motion device is again disconnected, so that the machine will function properly. The yarn 10 is then pulled essentially coaxially to the axis of rotation 24 of the drum 1—see FIG. 4. The bail 27 itself can be fixed in this position by suitable operation of the latch 31. With reference to FIG. 2, lever 31 is pivoted counterclockwise so that bail 30 will be held in place by the right-hand end of catch 31 which will hook behind the side legs of bail 30, when bail 30 is pivoted to the right.

It is also possible to set the position of the bail 30 by adjustment of its biasing element, for example a weight, or spring, to hold it in the position shown in FIG. 4; this, however, would then result in response of the stop-motion device and a separate override circuit would have to be provided if the machine is to be operated.

If the bail 30 is in the broken line position of FIG. 4, the yarn 10 is guided into the slits 23, that is, out from the depression 26 and along the slit towards the axis of rotation 24.

Upon transition to normal positive thread supply, it is only necessary to unlatch the bail 30 and to hold it in deflected position, that is, deflected in clockwise direction. The thread 10 will then automatically move along the slit 23 into the opening 22 and then snap over into the depression 26, whereupon normal operation as illustrated in FIG. 3, is reestablished.

The intermediate guide element 20 is illustrated in form of a sheet metal element. It could also be formed by a suitably shaped wire structure 120 (see FIG. 6), or bent-wire arrangement defining a contour similar to slot 23 and adjacent openings 26. Of course, the element 20 could be constructed as an assembly with a holding element different from element 16 or of structural components which are relatively arranged to carry out the functions explained herein in connection with the single element 20.

Locating the guide edges 25, 25' at both sides laterally with respect to the longitudinal slits 23, and separated therefrom by a slight hump or projection has the effect that, upon decreasing tension, the yarn is first guided towards the base of the depression formed adjacent the hump, that is, towards the respective guide surface due to the loading of the yarn by the yarn sensing bail 30 under the force symbolized by arrow A. After the stop-motion or sensing bail 30 has responded, the loop of yarn which then will form is no longer loaded by the bail 30 so that, as the drum 1 continues to rotate under inertia, the now untensioned yarn can escape from the depression and the guide surface and is guided into the slit 23.

Forming the yarn guide element with an opening extending transversely thereacross, that is, across the width thereof and spanning the yarn guide surfaces prevents release of the yarn, upon loss of tension, from the intermediate yarn guide element and holds the yarn essentially in the position where, upon re-starting of the machine, yarn can be supplied directly and without interruption due to possible entanglement with machine elements. This opening preferably is surrounded by a continuous edge, that is, it is an opening which is enclosed by a surrounding structure although a small slit can be formed therein to facilitate threading of yarn therethrough. Such a small slit preferably should extend in a direction which the yarn is unlikely to assume upon loss of tension.

The loop deflector is particularly useful when working with yarn which has the tendency to twist about itself, or which has a high degree of uncontrolled twist when untensioned. The deflecting element guides twisted loops laterally with respect to the intermediate yarn guide element 20 in such a manner that loops and kinks which may form cannot knot themselves together or catch on machine parts or parts of the apparatus itself. Extending the guide slit 23 forwardly up to the axis of rotation 24 of the drum, or at least approximately thereto has the advantage that the yarn can be pulled off coaxially with respect to the axis of rotation from the storage drum.

Usually, the thread sensing element which operates the stop-motion mechanism and senses thread tension, or presence of the thread in advance of the supply of the thread or yarn to a utilization position is formed as an eye; it has been found advantageous, however, to use a construction as shown in which the thread sensor is a U-shaped bail since the run-out path of the thread or yarn is thereby improved and a wider range of thread positions can be sensed without interfering with movement of the thread or yarn as such. In a preferred form, the bail 30 is a closed element which is hooked with its upper ends into suitable openings in the bracket 5.

When starting the textile machine, typically a circular knitting machine, it is customary to operate at least some of the yarn supply devices with negative yarn supply, that is, with pull-off speed of the yarn which is independent of the speed of yarn being wound on the drum. Locking the bail 30 by the catch 31 readily permits this operation of the machine, and additionally permits use of the bail as a guide element to guide the thread head-over-end from the storage drum. When positive yarn supply is to be resumed, it is only necessary to unlatch the sensing element and move it into its operating position. The yarn will automatically follow the sensing element and snap into its appropriate location in the depression 26 adjacent the guide surface 25, or 25' respectively, as selected by the directing element 27. The directing element 27, as such, can be placed as desired in accordance with the respective direction of rotation of the drum.

Various changes and modifications may be made within the scope of the inventive concept.

We claim:

1. Yarn delivery apparatus for use in textile machines comprising a storage drum (1) having a lower edge (18), on which at least one loop of yarn is wound to form a storage winding supply (14);

supply guiding means (9, 11, 12, 13) to guide yarn (10) to be supplied to a drum (1);

removal guiding means (17) to guide yarn being removed from the storage windings on the drum (1) and located laterally with respect to the axis of rotation (24) of the drum, and including, an intermediate yarn guide element (20, 120) located between the lower edge (18) of the drum (1) and said yarn removal guide means (17), said intermediate guide element (20, 120) being formed with at least one yarn guide edge (25) located adjacent the path of the yarn from the storage winding to the removal guide means (17) and laterally with respect to the axis of rotation (24) of the drum and with an elongated narrow guide slot (23) extending from adjacent said guide edge toward the axis of rotation (24) of the drum;

and a movable yarn sensing element (30) located in a position between said yarn guide edge (25) and the yarn removal guide means (17), said yarn sensing element being biased for movement toward the axis of rotation (24) of the drum absent tension of yarn passing thereover from the storage windings of the drum toward the yarn removal guide means (17).

2. Apparatus according to claim 1, wherein the yarn guide edge (25) is located in a depression formed in an opening in said intermediate yarn guide element;

and a projecting hump is located between said guide edge (25, 25') and said narrow slot (23).

3. Apparatus according to claim 1, wherein the intermediate yarn guide element (20, 120) is formed with an opening therein extending transversely with respect to said elongated guide slot (23), the yarn guide edge (25) being formed by a surface of said element adjacent said opening (22), the elongated slot (23) terminating said opening.

4. Apparatus according to claim 1, wherein the intermediate yarn guide element (20, 120) is located in a plane extending approximately parallel, or with slight inclination with respect to the lower surface of the drum;

said guide slot (23) being located in a plane which includes the axis of rotation (24) of the drum and said yarn removal guide means (17).

5. Apparatus according to claim 4, wherein the guide edge (25, 25') is located laterally adjacent the longitudinal axis of the guide slot (23).

6. Apparatus according to claim 1, further comprising a loop deflection element (129) positioned below the intermediate yarn guide element (20, 120).

7. Apparatus acording to claim 6, wherein the loop deflection element (129) is attached to the intermediate yarn guide element (20) and comprises a re-entrant structure extending essentially parallel to and below the yarn guide element (20, 120).

8. Apparatus according to claim 7, wherein the yarn guide element (20, 120) and the yarn deflection element (129) comprise a unitary structure of general U-shape, said elongated guide slot (23) being formed in one leg of the U and the other leg of the U forming the yarn deflection element (129).

9. Apparatus according to claim 6, wherein the yarn deflection element (129) is laterally tapered.

10. Apparatus according to claim 1, wherein the narrow slot (23) extends up to or approximately the axis of rotation (24) of the storage drum (1).

11. Apparatus according to claim 1, wherein the movable yarn sensing element (30) comprises a pivoted bail (30) which is pivotable about an axis extending transverse to the axis of rotation (24) of the drum and having a portion extending transverse to the path of the yarn (10) from the storage windings (14) on the drum to the yarn removal guide means (17).

12. Apparatus according to claim 11, wherein the yarn sensing bail (30) is an essentially U-shaped element, the ends of the legs of the U being pivotally located to pivot about said pivot axis.

13. Apparatus according to claim 12, further comprising a loop deflection element (129) positioned below the intermediate yarn guide element (20, 120);

and wherein the yarn sensing bail (30) is pivotable to move in the space between the loop deflection element (129) and said intermediate yarn guide element (20, 120).

14. Apparatus according to claim 12, wherein the yarn sensing bail (30) is coupled to a stop-motion mechanism, said stop-motion mechanism being operated to stop operation of the textile machine with which the apparatus is associated when the legs of the U-shaped bail are approximately parallel to the axis of rotation (24) of the drum (1).

15. Apparatus according to claim 11, wherein said bail (30) is pivotable beyond a position sensing presence of the yarn and absence of the yarn and toward a position where the transverse portion of the bail is approximately in the vicinity of the axis of rotation (24) of the drum;

and latch means (31) are provided to lock the bail (30) in the deflected position where the transverse portion of the bail is adjacent the axis of rotation of the drum.

16. Apparatus according to claim 1, wherein two yarn guide edges (25, 25') are provided, one edge, each, being located laterally at the adjacent side of the guide slot (23).

17. Apparatus according to claim 16, further comprising a yarn directing element (27) operatively associated with the intermediate yarn guide element (20, 120) and positioned to block engagements by the yarn (10), selectively, of one or the other of said guide edges (25, 25').

18. Apparatus according to claim 3, wherein two yarn guide edges (25, 25') are provided, one each located at either side of the elongated narrow guide slot (23);

and yarn directing element (27) is operatively associated with the intermediate guide element (20, 120), the yarn directing element extening transversely across the opening (22), selectively, over one or the other of the yarn guide edges (25, 25') to block engagement of the yarn with the respective yarn guide edge which is being blocked, and direct the yarn to the other yarn guide edge or into the elongated guide slot, respectively.

19. Apparatus according to claim 1, wherein the intermediate yarn guide element (20) is a sheet metal part.

20. Apparatus according to claim 1, wherein the intermediate yarn guide element (120) is a bent wire shaped part.

21. Apparatus according to claim 18, wherein the intermediate yarn guide element (20, 120) is located in a plane extending approximately parallel, or with slight inclination with respect to the lower surface of the drum;

said guide slot (23) being located in a plane which includes the axis of rotation (24) of the drum and said yarn removal guide means (17);

the narrow slot (23) extending up to or approximately the axis of rotation of the storage drum (1);

and a loop deflection element (129) positioned below the intermediate yarn guide element (20, 120);

and wherein the yarn sensing bail (30) is pivotable to move in the space between the loop deflection element (129) and said intermediate yarn guide element (20, 120).

* * * * *